US010921725B2

(12) United States Patent
Tzomik et al.

(10) Patent No.: US 10,921,725 B2
(45) Date of Patent: Feb. 16, 2021

(54) PRINTING SUBSTRATES

(71) Applicant: HP Indigo B.V., Amstelveen (NL)

(72) Inventors: Inna Tzomik, Nes Ziona (IL); Daniel Skvirsky, Nes Ziona (IL); Faina Kogan, Nes Ziona (IL); Gleb Romantcov, Nes Ziona (IL); Asaf Salant, Nes Ziona (IL); Daniel Tulchinski, Nes Ziona (IL)

(73) Assignee: HP Indigo B.V., Amstelveen (NL)

( * ) Notice: Subject to any disclaimer, the term of this patent is extended or adjusted under 35 U.S.C. 154(b) by 195 days.

(21) Appl. No.: 16/068,506

(22) PCT Filed: Mar. 24, 2016

(86) PCT No.: PCT/EP2016/056671
§ 371 (c)(1),
(2) Date: Jul. 6, 2018

(87) PCT Pub. No.: WO2017/162305
PCT Pub. Date: Sep. 28, 2017

(65) Prior Publication Data

US 2019/0018333 A1 Jan. 17, 2019

(51) Int. Cl.
*G03G 13/10* (2006.01)
*G03G 15/10* (2006.01)
(Continued)

(52) U.S. Cl.
CPC ..... *G03G 13/10* (2013.01); *G03G 7/008* (2013.01); *G03G 7/0053* (2013.01); *G03G 9/131* (2013.01);
(Continued)

(58) Field of Classification Search
CPC ..... G03G 13/10; G03G 15/10; G03G 2215/00527
See application file for complete search history.

(56) References Cited

U.S. PATENT DOCUMENTS 6,316,120 B1 * 11/2001 Emslander ..... G03G 7/008 428/522
6,773,653 B2 8/2004 Miller et al.
(Continued)

FOREIGN PATENT DOCUMENTS

EP 1818171 8/2007
JP 2007272064 A * 10/2007 ..... G03G 9/12
(Continued)

OTHER PUBLICATIONS

English language machine translation of JP 2007-272064 (Year: 2007).*
(Continued)

*Primary Examiner* — Christopher D Rodee
(74) *Attorney, Agent, or Firm* — Thorpe North & Western LLP

(57) ABSTRACT

The present disclosure relates to a process for printing a substrate. The process comprises applying an analogue primer over a print substrate. A transparent electrophotographic composition comprising a coupling agent is electrophotographically printed on the primer as a coupling layer. An electrophotographic ink composition is then printed on the coupling layer to form an image layer. The coupling layer is disposed between the primer and image layer and in contact with each of the primer and image layer.

8 Claims, 1 Drawing Sheet

(51) Int. Cl.
*G03G 7/00* (2006.01)
*G03G 9/13* (2006.01)

(52) U.S. Cl.
CPC ..... *G03G 9/132* (2013.01); *G03G 15/10* (2013.01); *G03G 2215/00527* (2013.01); *G03G 2215/0626* (2013.01)

(56) References Cited

U.S. PATENT DOCUMENTS

| | | | | |
|---|---|---|---|---|
| 6,929,846 | B2 | 8/2005 | Kamiyama | |
| 8,440,749 | B2 | 5/2013 | Kagaya et al. | |
| 8,865,295 | B2 | 10/2014 | Jahromi et al. | |
| 10,564,562 | B2 * | 2/2020 | Ron | G03G 7/0006 |
| 2006/0216497 | A1 | 9/2006 | Torikoshi et al. | |
| 2008/0057433 | A1 * | 3/2008 | Anderson | G03G 15/2064 430/126.1 |
| 2015/0227064 | A1 * | 8/2015 | Bandriss | G03G 15/10 156/277 |
| 2016/0046825 | A1 | 2/2016 | Hood et al. | |
| 2016/0109817 | A1 * | 4/2016 | Ron | G03G 7/002 430/117.1 |

FOREIGN PATENT DOCUMENTS

| | | | | |
|---|---|---|---|---|
| JP | 2012208150 | | 10/2012 | |
| WO | 2010104626 | | 9/2010 | |
| WO | 2013062530 | | 5/2013 | |
| WO | 2014206492 | | 12/2014 | |
| WO | 2014206494 | | 12/2014 | |
| WO | 2015144212 | | 10/2015 | |
| WO | 2017067610 | | 4/2017 | |
| WO | 2017067611 | | 4/2017 | |
| WO | WO-2017097371 | A1 * | 6/2017 | G03G 9/1355 |

OTHER PUBLICATIONS

English language machine translation of JP 2012-208150. (Year: 2012).*

International Search Report dated Dec. 5, 2016 for PCT/EP2016/056671, Applicant Hewlett-Packard Indigo B.V.

* cited by examiner

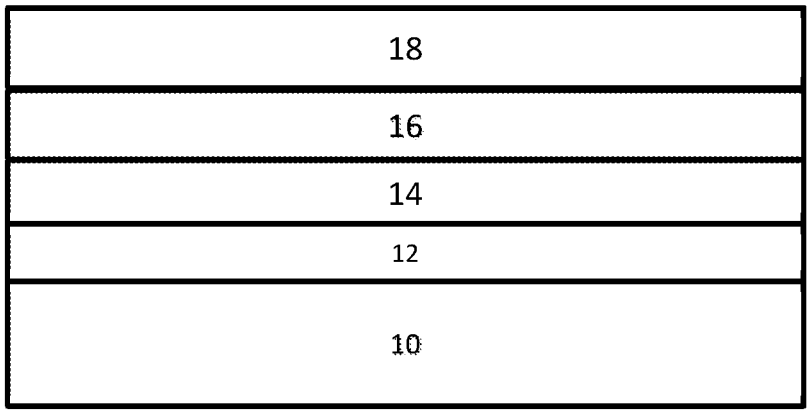
18
16
14
12
10

PRINTING SUBSTRATES

BACKGROUND

In a printing process, ink is printed onto a substrate to form an image. The durability of the image may depend on the strength of the bond between the ink and the substrate. Some inks do not adhere effectively to certain substrates, for example, polymeric films. To improve adhesion, primers can be used to enhance the bond between ink and substrate. For example, a polymer film may be coated with a primer prior to printing to improve the adhesion of the ink onto the polymeric film. The primer may be applied, for example, by gravure coating. The ink may then be printed onto the primed substrate.

Once printed, the film may be used to produce a variety of products, including flexible packaging (e.g. shrink sleeves).

BRIEF DESCRIPTION OF THE DRAWINGS

Various implementations are described, by way of example, with reference to the accompanying drawings, in which:

The FIGURE is a schematic diagram showing the layers that may be applied onto a substrate according to one example of the present disclosure.

DETAILED DESCRIPTION

Before the present disclosure is described, it is to be understood that this disclosure is not limited to the particular process steps and materials disclosed in this description because such process steps and materials may vary. It is also to be understood that the terminology used in this disclosure is used for the purpose of describing particular examples. The terms are not intended to be limiting.

It is noted that, as used in this specification and the appended claims, the singular forms "a," "an," and "the" include plural referents unless the context clearly dictates otherwise.

As used in this disclosure, "co-polymer" refers to a polymer that is polymerized from at least two monomers. The term "terpolymer" refers to a polymer that is polymerized from 3 monomers.

As used in this disclosure, "melt index" and "melt flow rate" are used interchangeably. The "melt index" or "melt flow rate" refers to the extrusion rate of a resin through an orifice of defined dimensions at a specified temperature and load, reported as temperature/load, e.g. 190° C./2.16 kg. In the present disclosure, "melt flow rate" or "melt index" is measured per ASTM D1238-04c Standard Test Method for Melt Flow Rates of Thermoplastics by Extrusion Plastometer. If a melt flow rate of a particular polymer is specified, unless otherwise stated, it is the melt flow rate for that polymer alone, in the absence of any of the other components of the electrophotographic or electrostatic composition.

As used in this disclosure, "acidity," "acid number," or "acid value" refers to the mass of potassium hydroxide (KOH) in milligrams that neutralizes one gram of a substance. The acidity of a polymer can be measured according to standard techniques, for example as described in ASTM D1386. If the acidity of a particular polymer is specified, unless otherwise stated, it is the acidity for that polymer alone, in the absence of any of the other components of the liquid toner composition.

As used in this disclosure, "melt viscosity" refers to the ratio of shear stress to shear rate at a given shear stress or shear rate. Testing may be performed using a capillary rheometer. A plastic charge is heated in the rheometer barrel and is forced through a die with a plunger. The plunger is pushed either by a constant force or at constant rate depending on the equipment. Measurements are taken once the system has reached steady-state operation. One method used is measuring Brookfield viscosity @ 140° C., units are mPa-s or cPoise, as known in the art. Alternatively, the melt viscosity can be measured using a rheometer, e.g. a commercially available AR-2000 Rheometer from Thermal Analysis Instruments, using the geometry of: 25 mm steel plate-standard steel parallel plate, and finding the plate over plate rheometry isotherm at 120° C., 0.01 Hz shear rate. If the melt viscosity of a particular polymer is specified, unless otherwise stated, it is the melt viscosity for that polymer alone, in the absence of any of the other components of the electrostatic or electrophotographic composition.

A polymer may be described as comprising a certain weight percentage of monomer. This weight percentage is indicative of the repeating units formed from that monomer in the polymer.

If a standard test is mentioned in this disclosure, unless otherwise stated, the version of the test to be referred to is the most recent at the time of filing this patent application.

As used in this disclosure, "electrostatic" or "electrophotographic" are used interchangeably. An "electrostatic" or "electrophotographic" printing process refers to a process that provides an image that is transferred from a photoconductive surface or photo imaging plate either directly or indirectly via an intermediate transfer member to a print substrate. As such, the image may not be substantially absorbed into the photo imaging substrate on which it is applied. Additionally, "electrophotographic printers" or "electrostatic printers" refer to those printers capable of performing electrophotographic printing or electrostatic printing, as described above. An electrophotographic printing process may involve subjecting the electrophotographic composition to an electric field, e.g. an electric field having a field gradient of 1-1400V/μm, or more, in some examples 600-900V/μm, or more.

In this disclosure, the term "epoxide equivalent weight" is the weight in grams of an epoxy resin containing 1 mole equivalent of epoxide (g/mol). This is determined by ASTM D1652.

As used in this disclosure, the term "about" is used to provide flexibility to a numerical value or range endpoint by providing that a given value may be a little above or a little below the endpoint to allow for variation in test methods or apparatus. The degree of flexibility of this term can be dictated by the particular variable and would be within the knowledge of those skilled in the art to determine based on experience and the associated description in this disclosure.

As used in this disclosure, a plurality of items, structural elements, compositional elements, and/or materials may be presented in a common list for convenience. However, these lists should be construed as though each member of the list is individually identified as a separate and unique member. Thus, no individual member of such list should be construed as a de facto equivalent of any other member of the same list solely based on their presentation in a common group without indications to the contrary.

Concentrations, amounts, and other numerical data may be expressed or presented in this disclosure in a range format. It is to be understood that such a range format is used merely for convenience and brevity and thus should be interpreted flexibly to include not just the numerical values explicitly recited as the limits of the range, but also to include all the individual numerical values or sub-ranges encompassed within that range as if each numerical value and sub-range is explicitly recited. As an illustration, a numerical range of "about 1 wt % to about 5 wt %" should be interpreted to include not just the explicitly recited values of about 1 wt % to about 5 wt %, but also include individual values and subranges within the indicated range. Thus, included in this numerical range are individual values such as 2, 3.5, and 4 and sub-ranges such as from 1-3, from 2-4, and from 3-5. This same principle applies to ranges reciting a single numerical value. Furthermore, such an interpretation should apply regardless of the breadth of the range or the characteristics being described.

The present disclosure relates to a process for printing a substrate. The process comprises applying an analogue primer over a print substrate. A transparent electrophotographic composition comprising a coupling agent is electrophotographically printed on the primer as a coupling layer. An electrophotographic ink composition is then printed on the coupling layer to form an image layer. The coupling layer is disposed between the primer and image layer and in contact with each of the primer and image layer.

The present disclosure also relates to a liquid transparent electrophotographic composition. The composition comprises an epoxy resin; a copolymer of an olefin and methacrylic acid and/or a copolymer of an olefin and acrylic acid; a charge adjuvant; and a liquid carrier. The total amount of epoxy resin is 10 to 95 weight % of the total weight of solids in the composition.

The present disclosure also relates to a printed substrate comprising a print substrate; an analogue primer disposed over the print substrate; a coupling layer electrophotographically printed on the primer; and an image layer electrophotographically printed on the coupling layer. The coupling layer is formed from a transparent electrophotographic composition comprising a coupling agent. Each of the coupling layer and the image layer comprises a charge adjuvant.

Analogue primers can be applied to substrates, for example, by gravure coating to enhance the adhesion of an electrophotographic ink to the substrate. It has been found, however, that some primers can decrease the water-resistance of the printed substrate. Furthermore, the interface between the primer and the electrophotographic ink may be susceptible to degradation, for example, by heat and/or solvents.

The present inventors have found that it is possible to electrophotographically print a transparent electrophotographic composition comprising a coupling agent over the primer as a coupling layer. The coupling agent may be activated, for example, by heat to couple (e.g. crosslink or bond) the coupling layer to at least one of the primer and image layer. This may increase the strength of the bond between the image layer and the primer, providing a printed substrate with an improved resistance to, for example, water, heat and/or solvents.

Coupling Agent

The transparent electrophotographic composition comprises a coupling agent. The coupling agent may be present in an amount of 10 to 95 weight % of the total weight of solids in the transparent electrophotographic composition, for example, 40 to 90 weight %. In one example, the amount of coupling agent is 50 to 80 weight % of the total weight of solids of the transparent electrophotographic composition. In one example, the amount of coupling agent is 55 to 75 weight %, for instance, 60 or 65 to 73 weight % of the total weight of solids of the transparent electrophotographic composition.

The coupling agent may be any agent that can interact with the primer and/or image layer to, for example, improve the adhesion of the image layer to the substrate. The coupling agent may react with, for example, the primer resin or resin in the image layer to form a covalent bond. In one example, the coupling agent may react with the primer resin and/or resin in the image layer in an acid-base reaction to form a salt. Alternatively, the coupling agent may interact with, for example, the primer resin or resin in the image layer by an electrostatic interaction, hydrogen-bonding or van der Waals forces. An example of a coupling agent that may interact by an electrostatic interaction, hydrogen bonding or van der Waals forces is a thermoplastic resin polymer comprising carboxylic acid groups, for example, a copolymer of an olefin (e.g. ethylene) and acrylic acid or methacrylic acid. Other examples of suitable thermoplastic resins are described below.

The coupling agent may be a crosslinking agent (also termed "crosslinker"). The crosslinking agent may react with the primer and/or the image layer to crosslink the coupling layer to at least one of the primer and image layer. In one example, the crosslinking agent may react with the primer resin and/or thermoplastic resin in the image layer. For example, where the primer resin comprises an amine group (e.g. the primer resin is a polyethyleneimine resin), the crosslinking agent may react with the amine group to crosslink the primer resin with the coupling layer. Where the electrophotographic ink composition of the image layer comprises an acidic thermoplastic resin, the crosslinking agent may react with acid groups (e.g. carboxylic acid groups) in the thermoplastic resin to crosslink the image layer to the coupling layer. In one example, the crosslinking agent contains an epoxy group or an anhydride group.

The crosslinking agent may be solid. For example, the transparent electrophotographic composition may comprise particles of a crosslinking agent and particles of thermoplastic resin (e.g. a copolymer of an olefin (e.g. ethylene) and methacrylic acid and/or a copolymer of an olefin (e.g. ethylene) and acrylic acid) dispersed in a liquid carrier. Alternatively or additionally, the electrophotographic composition may comprise composite particles comprising (i) a crosslinking agent and (ii) thermoplastic resin (e.g. a copolymer of an olefin (e.g. ethylene) and methacrylic acid and/or a copolymer of an olefin (e.g. ethylene) and acrylic acid) dispersed in a liquid carrier.

Any suitable crosslinking agent may be present in the transparent electrophotographic composition.

In some examples, the cross-linking agent comprises a cross-linker selected from an epoxide, an anhydride, an aziridine, an isocyanate, a maleic anhydride, an organic metallic complex or ion, an organosilane, an epoxy organosilane, a carbodiimide, an aldehyde, a ketone, an acetyl acetonate or combinations thereof. For example, the cross-linking agent may comprise an epoxide, an aziridine, an isocyanate, a maleic anhydride, an organic metallic complex or ion, an organosilane, an epoxy organosilane, a carbodiimide, an aldehyde, a ketone, an acetyl acetonate, an anhydride or combinations thereof.

In some examples, the cross-linking agent comprises a cross-linker selected from an epoxide, an aziridine, and a carbodiimide. In some examples the crosslinking agent comprises an epoxide.

In some examples, the cross-linking agent comprises a cross-linker in an amount greater than about 0.01 wt. % by total weight of the transparent electrophotographic composition, in some examples greater than about 0.1 wt. %, in some examples greater than about 0.5 wt. %, in some examples greater than about 1 wt. %, in some examples greater than about 1.5 wt. %, in some examples greater than about 2 wt. %, in some examples greater than about 2.5 wt. %, in some examples greater than about 3 wt. %, in some examples about 4 wt. % or greater, in some examples about 5 wt. % or greater, in some examples about 5 wt. %.

In some examples, the cross-linking agent comprises a cross-linker in an amount up to about 20 wt. % by total weight of the transparent electrophotographic, in some examples up to about 15 wt. %, in some examples up to about 10 wt. %. The remaining wt. % of the cross-linking composition may be a carrier solvent as described below.

In some examples, the cross-linking composition comprises a cross-linker in an amount within the range of about 0.5 wt. % to about 10 wt. % by total weight (including solvent) of the transparent electrophotographic composition.

The crosslinking agent may be present in an amount of 40 to 95 weight % of the total weight of solids in the transparent electrophotographic composition, for example, 50 to 80 weight % of the total weight of solids of the transparent electrophotographic composition. In one example, the amount of crosslinking agent is 55 to 75 weight %, for instance, 60 or 65 to 73 weight % of the total weight of solids of the transparent electrophotographic composition.

In some examples, the crosslinking agent has a molecular weight of more than 5000 Daltons. In some examples, the crosslinking agent has a 20 molecular weight of 5000 Daltons or less, in some examples 4000 Daltons or less, in some examples, 3000 Daltons or less, in some examples 1500 Daltons or less, in some examples a molecular weight of 1000 Daltons or less, in some examples a molecular weight of 700 Daltons or less, in some examples a molecular weight of 600 Daltons or less. In some examples, the crosslinking agent has a molecular weight of 25 from 100 to 1500 Daltons, in some examples, in some examples a molecular weight of from 100 to 600 Daltons.

In some examples, the cross-linker is an epoxy-based cross-linker, for example a polyepoxide. The term 'polyepoxide' is used herein to refer to a molecule comprising at least two epoxy groups, e.g. of the formula —CH(O)$R^1$H, wherein $R^1$ is selected from H and alkyl, in some examples wherein $R^1$ is H.

In some examples, the epoxy-based cross-linker is of the formula (I).

$$(X)—(Y—[Z—F]_m)_n$$

wherein, in each (Y—[Z—F]$_m$), Y, Z and F are each independently selected, such that F is an epoxy group, e.g. of the formula —CH(O)$R^1$H, wherein $R^1$ is selected from H and alkyl;

Z is alkylene,

Y is selected from (i) a single bond, —O—, —C(═O)—O—, —O—C(═O)— wherein m is 1 or (ii) Y is $NH_{2-m}$ wherein m is 1 or 2, n is at least 1, in some example at least 2, in some examples 2-4, and X is an organic group.

In some examples, the cross-linker of formula (I) has at least two F groups.

In some examples, F is an epoxide of the formula —CH(O)$CR^1$H in which $R^1$ is H X may comprise or be an organic group selected from optionally substituted alkylene, optionally substituted alkyl, optionally substituted aryl, optionally substituted arylalkyl, optionally substituted alkylaryl, isocyanurate, and a polysiloxane. X may comprise a polymeric component; in some examples the polymeric components may be selected from a polysilane, polysiloxane (such as poly(dimethyl siloxane), a polyalkylene (such as polyethylene or polypropylene), an acrylate (such as methyl acrylate) and a poly(alkylene glycol) (such as poly(ethylene glycol) and poly(propylene glycol)), and combinations thereof. In some examples X comprises a polymeric backbone, comprising a plurality of repeating units, each of which is covalently bonded to (Y—[Z—F]$_m$), with Y, Z, F and m as described herein. X may be selected from a group selected from a branched or straight-chain $C_{1-5}$ alkyl (e.g. methyl), phenyl, methylene bisphenyl, trisphenylmethane, cyclohexane, isocyanurate.

In some examples, Y is selected from a single bond, —O—, —C(═O)—O—, —O—C(═O)—, m is 1, and X is an organic group selected from alkylene (e.g. $C_{1-6}$ alkylene), optionally substituted alkylene (e.g. $C_{1-6}$ alkylene), aryl (e.g. $C_{5-12}$ aryl), optionally substituted aryl (e.g. $C_{5-12}$ aryl), arylalkyl (e.g. $C_{6-20}$ arylalkyl), optionally substituted arylalkyl (e.g. $C_{6-20}$ arylalkyl), alkylaryl (e.g. $C_{6-20}$ alkylaryl) and optionally substituted alkylaryl (e.g. $C_{6-20}$ alkylaryl). In some examples, Y is selected from a single bond, —O—, —C(═O)—O—, —O—C(═O)—, m is 1, and X is an organic group selected from alkylene, aryl, arylalkyl, and alkylaryl. In some examples, Y is selected from a single bond, —O—, —C(═O)—O—, —O—C(═O)—, m is 1, and X is an organic group selected from $C_{1-6}$ alkylene, $C_{5-12}$ aryl, $C_{6-20}$ arylalkyl, and $C_{6-20}$ alkylaryl. In some examples, Y is selected from a single bond, —O—, —C(═O)—O—, —O—C(═O)—, m is 1, and X is an organic group selected from $C_{1-6}$ alkylene (e.g. methylene), phenyl, methylene bisphenyl, trisphenylmethane, cyclohexane.

In some examples, X is selected from (i) an alkane, which may be an optionally substituted straight chain, branched or cyclo-alkane, (ii) a cyclo alkane having at least two substituents that are Y—[Z—F]$_m$ and (iii) an aryl (such as phenyl). In some examples, X is selected from (i) a branched alkane, with at least at least two of the alkyl branches covalently bonded to (Y—[Z—F]$_m$) and (ii) a cyclo alkane having at least two substituents that are Y—[Z—F]$_m$ and (iii) an aryl (such as phenyl) having at least two substituents that are Y—[Z—F]$_m$; Y is selected from (i) —O—, —C(═O)—O—, —O—C(═O)— and m is 1 or (ii) Y is —$NH_{2-m}$, wherein m is 1 or 2; Z is $C_{1-4}$ alkylene; F is an epoxide of the formula —CH(O)$CR^1$H, wherein $R^1$ is selected from H and methyl, and in some examples F is an epoxide of the formula —CH(O)$CR^1$H in which $R^1$ is H.

In some examples, Z—F is an epoxycycloalkyl group. In some examples, Z—F is an epoxycyclohexyl group. In some examples, Z—F is an epoxycyclohexyl group, in some examples a 3,4 epoxycyclohexyl group. In some examples, the cross-linker comprises two epoxycycloalkyl groups, in some examples two epoxycyclohexyl groups.

In some examples, the cross-linker comprises two epoxycycloalkyl groups, which are bonded to one another via a linker species; and the linker species may be selected from a single bond, optionally substituted alkyl, optionally substituted aryl, optionally substituted arylalkyl, optionally substituted alkylaryl, isocyanurate, a polysiloxane, —O—, —C(═O)—O—, —O—C(═O)—, and amino and combinations thereof. In some examples, the linker species may be selected from alkylene, —O—, —C(═O)—O— and —O—C(═O)—. In some examples, the linker species may be selected from —C(═O)—O— and —O—C(═O)—.

In some examples the epoxy-based cross-linker is selected from the DECH family of epoxy-based cross-linkers (including 3,4-Epoxycyclohexylmethyl 3,4-epoxycyclohexanecarboxylate and 7-oxabicyclo[4.1.0]hept-3-ylmethyl 7-oxabicyclo[4.1.0]heptane-3-carboxylate) and tris(4-hydroxyphenyl)methane triglycidyl ether. In some examples the epoxy-based cross-linker is selected from 3,4-Epoxycyclohexylmethyl 3,4-epoxycyclohexanecarboxylate and 7-oxabicyclo[4.1.0]hept-3-ylmethyl 7-oxabicyclo[4.1.0]heptane-3-carboxylate, in some examples 7-oxabicyclo[4.1.0]hept-3-ylmethyl 7-oxabicyclo[4.1.0]heptane-3-carboxylate.

In some examples, the crosslinking agent is an epoxy resin, for example, a polyfunctional epoxy resin. Where an epoxy resin is employed, the epoxy resin may be present in an amount of 40 to 95 weight %, for example, 50 to 80 weight % of the transparent electrophotographic composition. In one example, the amount of epoxy resin is 55 to 75 weight %, for instance, 60 or 65 to 73 weight % of the total weight of solids of the transparent electrophotographic composition.

Particles of epoxy resin may be dispersed in the liquid carrier of the transparent electrophotographic composition. Thus, in some examples, the transparent electrophotographic composition comprises particles of epoxy resin and particles of a thermoplastic resin comprising, for example, a copolymer of an olefin (e.g. ethylene) and methacrylic acid and/or a copolymer of an olefin (e.g. ethylene) and acrylic acid. In other examples, the transparent electrophotographic composition comprises composite particles comprising (i) epoxy resin and (ii) thermoplastic resin (e.g. a copolymer of an olefin (e.g. ethylene) and methacrylic acid and/or a copolymer of an olefin (e.g. ethylene) and acrylic acid) dispersed in a liquid carrier.

Any suitable epoxy resin may be employed. Examples include epoxy resins having the group A below:

A

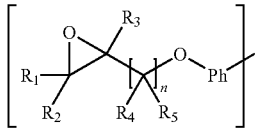

where $R_1$ to $R_5$ may be the same or different and selected from H and $C_1$ to $C_6$ alkyl. In one example, each of $R_1$ to $R_5$ is H.

n is an integer from 1 to 4, for example, 1.

Ph is a phenyl ring that may be substituted, for example, with an alkyl (e.g. $C_1$ to $C_6$) alkyl.

The epoxy resin may be polyfunctional, for example, with more than one group A.

The epoxy resin may be a novolac-free multifunctional epoxy resin or may be a phenolic novolac epoxide.

The epoxy resin may have an epoxide equivalent weight as determined by ASTM D1652 of 150-250 g/mol, for example, 150-240 g/mol. In one example, the epoxy resin may have an epoxide equivalent weight of 170-240, for instance, 195-230 g/mol.

In one example, the epoxy resin is 1,1,2,2-tetrakis (4-glycidoxyphenyl) ethane:

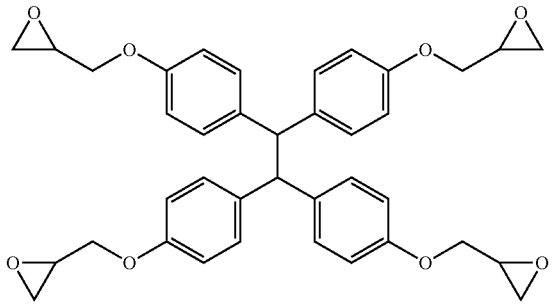

Such an epoxy resin may be sold under the trademark EPON™ Resin 1031 (Hexion®).

In one example, the epoxy resin is

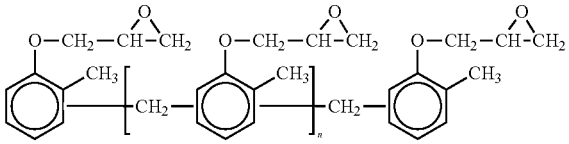

where n equals on average 3 to 4

Such an epoxy resin may be sold under the trademarks EPON™ Resins 164 & 165 (Hexion®).

In another example, the epoxy resin is

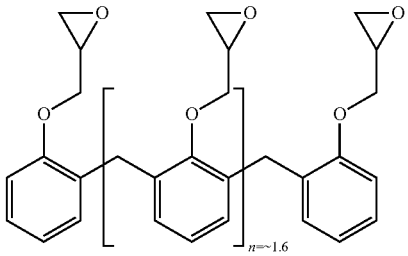

Such an epoxy resin may be sold under the trademark EPON™ Resin 154 (Hexion®).

In another example, the epoxy resin is tris-(hydroxyl phenyl)-methane based epoxy, for example, sold under the trademark Tactix® 742 (Ciba).

In another example, the epoxy resin is 1,1,1-tris-(p-Hydroxyphenyl)ethane glycidyl ether, for example, sold under the trademark EPALLOY® 9000.

In some examples, the epoxy resin is an epoxy phenol novolac resin. For example, the epoxy resin may be poly [(phenyl glycidyl ether)-co-formaldehyde. An example of such a resin is sold under the trademark EPALLOY® 8350.

In some examples, the cross-linker is an aziridine-based cross-linker, for example a polyaziridine. The term 'polyaziridine' is used herein to refer to a molecule comprising at least two aziridine groups, e.g. of the formula —$N(CH_2CR^2H)$, wherein $R^2$ is selected from H and alkyl (e.g. methyl), in some examples wherein $R^2$ is methyl.

In some examples, the aziridine-based cross-linker is of the formula (II).

$$(S)\text{-}(T\text{-}[W\text{—}V]_i)_k \quad \text{(II)}$$

wherein, in each $(T\text{-}[W\text{—}V]_i)$, T, W and V are each independently selected, such that V is an aziridine group, e.g. of the formula —N($CH_2CR^2H$), wherein $R^2$ is selected from H and alkyl;

W is alkylene,

T is selected from a single bond, —O—, —C(=O)—O—, —O—C(=O)— and i is 1 or (ii) Y is $NH_{2-i}$, wherein i is 1 or 2, k is at least 1, in some example at least 2, in some examples at least 3, in some examples 1-4, in some examples 2-4, and S is an organic group.

In some examples, the cross-linker of formula (II) has at least two V groups, in some examples at least three V groups.

In some examples, V is an aziridine of the formula —N($CH_2CR^2H$) in which $R^2$ is alkyl, in some examples $R^2$ is methyl.

S may comprise or be an organic group selected from optionally substituted alkylene, optionally substituted alkyl, optionally substituted aryl, optionally substituted arylalkyl, optionally substituted alkylaryl, isocyanurate, and a polysiloxane. S may comprise a polymeric component; in some examples the polymeric components may be selected from a polysiloxane (such as poly(dimethyl siloxane), a polyalkylene (such as polyethylene or polypropylene), an acrylate (such as methyl acrylate) and a poly(alkylene glycol) (such as poly(ethylene glycol) and poly(propylene glycol)), and combinations thereof. In some examples S comprises a polymeric backbone, comprising a plurality of repeating units, each of which is covalently bonded to (T-[W—V]$_i$), with T, W, V and i as described herein. S may be selected from a group selected from a branched or straight-chain $C_{1-12}$ alkyl (e.g. $C_{1-6}$).

In some examples, S is a branched-chain alkyl (e.g. trimethyl propane) in which each of the alkyl branch groups (e.g. each of the methyl groups when S is trimethyl propane) are substituted with a (T-[W—V]$_i$) group (i.e. k is 3 when S is trimethyl propane), in which T is selected from —O—, —C(=O)—O—, —O—C(=O)—, in some examples —O—C(=O)—; i is 1; W is $C_{1-4}$ alkylene, in some examples methylene (—$CH_2$—) or ethylene (—CH2-CH2-), in some examples ethylene; and V is an aziridine group of the formula —N($CH_2CR^2H$) in which $R^2$ is alkyl, in some examples, methyl.

In some examples the aziridine-based cross-linker is trimethylolpropane tris(2-methyl-1-aziridinepropionate) (XAMA®-2).

In some examples, the cross-linker is an isocyanate-based cross-linker, for example a polyisocyanate. The term 'polyisocyanate' is used herein to refer to a molecule comprising at least two isocyanate groups, e.g. of the formula —NCO.

In some examples, the isocyanate based cross-linker is selected from polymethylene diphenyl isocyanates, biuret, hexamethylene diisocyanate trimer (trimer of HDI), uretdion dimer (Alipa), blocked isocyanates (Cytec, Bayer, Alipa) and aliphatic polyisocyanates.

In some examples, the isocyanate based cross-linker is selected from polymethylene diphenyl isocyanates (e.g. Papi27 (Dow), Desmodur44V20 (Bayer), Suprasec5024 (Huntsman)), biuret, hexamethylene diisocyanate trimer (trimer of HDI), uretdion dimer (Alipa), blocked isocyanates (Cytec, Bayer, Alipa), aliphatic polyisocyanates, tolylene diisocyanate, diphenylmethane diisocyanate, naphthalene diisocyanate, xylylene diisocyanate, hydrogenated xylylene diisocyanate, hexamethylene diisocyanate, trimethylhexamethylene diisocyanate, isophorone diisocyanate, methylene-bis(4-cyclohexyl isocyanate),

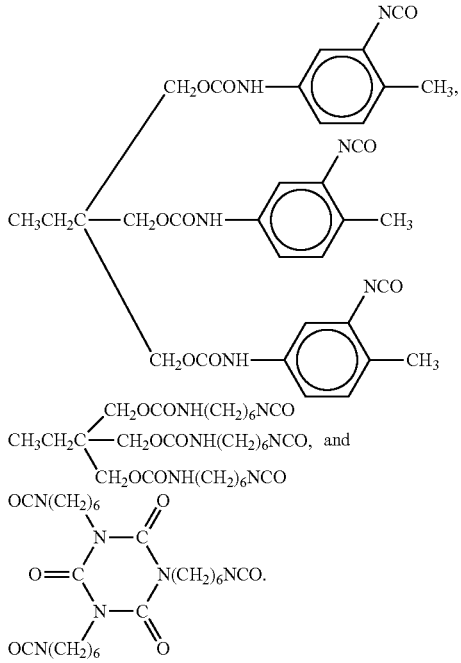

In some examples, the cross-linker is a carbodiimide-based cross-linker, for example a polycarbodiimide. The term 'polycarbodiimide' is used herein to refer to a molecule comprising at least two carbodiimide groups, e.g. of the formula —NCN—.

In some examples, the carbodiimide based cross-linker is SV-02 Carbodilite.

In some examples, the cross-linker is selected from organic metallic complexes or ions, for examples ionomers and $Zn^{2+}$, $Ca^{2+}$ containing compounds.

In some examples, the cross-linker comprises an anhydride, for example, an anhydride resin. Suitable examples include maleic anhydride and succinic anhydride resins. In some examples, the cross-linker is a polymaleic anhydride.

In some examples, the maleic anhydride-based cross-linker is of formula (III),

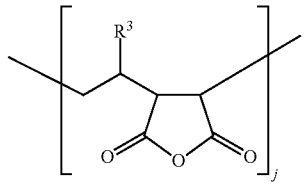

where $R^3$ is H or alkyl and j is greater than 1.

In some examples, j is greater than 10, in some examples greater than 100.

In some examples, $R^3$ is H or $C_{1-20}$ alkyl (e.g. $C_{16}$ alkyl).

In some examples, the maleic anhydride-based cross-linker is polymaleic anhydride 1-octadecene (available from Polyscience), poly(ethylene-alt-maleic anhydride) (available from Sigma).

In some examples, the cross-linker comprise an anhydride. In some examples, the cross-linker is an anhydride based cross-linker, e.g. a cross-linker comprising the group —C(O)OC(O)—.

In some examples, the anhydride based cross-linker is a cyclic anhydride, in some examples a cyclic anhydride of formula (IV)

$R^4C(O)OC(O)R^5$ where $R^4$ and $R^5$ are linked to form an optionally substituted ring.

In some examples, the anhydride based cross-linker is glutaric anhydride or phtalic anhydride.

In some examples, the cross-linker comprises a polyanhydride, for example polyacrylic anhydride or polymethacrylic anhydride.

In some examples, the cross-linker comprises an aldehyde. In some examples, the cross-linker is an aldehyde-based cross-linker, for example a polyaldehyde. The term 'polyaldehyde' is used herein to refer to a molecule comprising at least two aldehyde groups, e.g. of the formula —C(O)H.

In some examples, the cross-linker comprises a ketone. In some examples, the cross-linker is a ketone-based cross-linker, for example a polyketone. The term 'polyketone' is used herein to refer to a molecule comprising at least two ketone groups.

In some examples, the cross-linker comprises an acetyl acetonate. In some examples, the cross-linker is an acetyl acetonate based cross-linker, for example Acetoacetoxyethyl Methacrylate (Eastman™ AAEM).

In some examples, the cross-linker comprises an organosilane, for example a cross-linker comprising a silane group. In some examples, the organosilane may be of the formula $R'Si(R^6)(R^7)(R^8)$ wherein $R^6$, $R^7$ and $R^8$ are independently selected from optionally substituted alkoxy, optionally substituted alkyl and optionally substituted aryl; and R' is selected from optionally substituted alkoxy, optionally substituted alkyl (e.g. aminoalkyl) and optionally substituted aryl. In some examples, $R^6$, $R^7$ and $R^8$ are all alkyl, e.g. methyl. In some examples, R' is optionally substituted alkyl, e.g. amino substituted alkyl (e.g. $C_{1-12}$ aminoalkyl), or isocyanate substituted alkyl. In some examples, R' is $C_{1-6}$ aminoalkyl (e.g. aminopropyl).

In some examples, the cross-linker comprises trimethylaminopropylsilane.

In some examples, the cross-linker comprises an epoxy-organosilane, for example a cross-linker comprising a silane group (e.g. a group of formula $—Si(R^6)(R^7)(R^8)$ as described above) and an epoxy group as described above.

In some examples, the cross-linker comprises an epoxy-organosilane selected from epoxypropyltrimetoxysilane and oligomeric polyepoxysilane.

Electrophotographic Composition

An electrophotographic composition is a composition that can be printed onto a substrate by an electrophotographic printing process. In the present disclosure, a transparent electrophotographic composition and an electrophotographic ink composition are used. These electrophotographic compositions may be liquid. The electrophotographic compositions (i.e. the transparent electrophotographic composition and the electrophotographic ink composition) may comprise a thermoplastic resin dispersed in a liquid carrier. The liquid electrophotographic ink composition may also include a charge director and/or a charge adjuvant. In the case of a transparent electrophotographic composition, the composition comprises a coupling agent as described above. The transparent electrophotographic composition may also be devoid of colorant. The transparent electrophotographic composition may contain a solid polar compound. Where the second ink composition is a liquid electrophotographic composition, the composition may include a colorant.

Thermoplastic Resin

As described above, the electrophotographic compositions (transparent electrophotographic composition and/or electrophotographic ink composition) may comprise a thermoplastic resin. The thermoplastic resin may be a polymer of an alkylene (e.g. ethylene) and at least one of methacrylic acid or acrylic acid. In some examples, the thermoplastic resin comprises a first polymer of an alkylene (e.g. ethylene) and methacrylic acid and a second polymer of alkylene (e.g. ethylene) and acrylic acid. The ratio of the first polymer to the second polymer may be 1:1 to 10:1, for example, 2:1 to 8:1. In one example, ratio of the first polymer to the second polymer may be 3:1 to 6:1, for instance, 4:1 to 5:1. In one example, the transparent electrophotographic ink composition comprises a thermoplastic resin comprising a first copolymer of ethylene and methacrylic acid and a second copolymer of ethylene and acrylic acid. The ratio of the first polymer to the second polymer may be 1:1 to 10:1, for example, 2:1 to 8:1. In one example, ratio of the first polymer to the second polymer may be 3:1 to 6:1, for instance, 4:1 to 5:1. In one example, the first copolymer is a copolymer of ethylene and methacrylic acid sold under the trademark Nucrel® 699 (DuPont). In one example, the second copolymer is a copolymer of ethylene and acrylic acid sold under the trademark AC-5120 (Honeywell®).

In some examples, the thermoplastic resin may be a polymer selected from ethylene or propylene acrylic acid co-polymers; ethylene or propylene methacrylic acid co-polymers; ethylene vinyl acetate co-polymers; co-polymers of ethylene or propylene (e.g. 80 wt % to 99.9 wt %) and alkyl (e.g. C1 to C5) esters of methacrylic or acrylic acid (e.g. 0.1 wt % to 20 wt %); co-polymers of ethylene (e.g. 80 wt % to 99.9 wt %), acrylic or methacrylic acid (e.g. 0.1 wt % to 20.0 wt %) and alkyl (e.g. C1 to C5) esters of methacrylic or acrylic acid (e.g. 0.1 wt % to 20 wt %); co-polymers of ethylene or propylene (e.g. 70 wt % to 99.9 wt %) and maleic anhydride (e.g. 0.1 wt % to 30 wt %); polyethylene; polystyrene; isotactic polypropylene (crystalline); co-polymers of ethylene and ethyl acrylate; polyesters; polyvinyl toluene; polyamides; styrene/butadiene co-polymers; epoxy resins; acrylic resins (e.g. co-polymer of acrylic or methacrylic acid and at least one alkyl ester of acrylic or methacrylic acid wherein alkyl may have from 1 to about 20 carbon atoms, such as methyl methacrylate (e.g. 50% to 90%)/methacrylic acid (e.g. 0 wt % to 20 wt %)/ethylhexylacrylate (e.g. 10 wt % to 50 wt %)); ethylene-acrylate terpolymers: ethylene-acrylic esters-maleic anhydride (MAH) or glycidyl methacrylate (GMA) terpolymers; ethylene-acrylic acid ionomers and combinations thereof.

The resin may comprise a polymer having acidic side groups. The polymer having acidic side groups may have an acidity of 50 mg KOH/g or more, in some examples an acidity of 60 mg KOH/g or more, in some examples an acidity of 70 mg KOH/g or more, in some examples an acidity of 80 mg KOH/g or more, in some examples an acidity of 90 mg KOH/g or more, in some examples an acidity of 100 mg KOH/g or more, in some examples an acidity of 105 mg KOH/g or more, in some examples 110 mg KOH/g or more, in some examples 115 mg KOH/g or more. The polymer having acidic side groups may have an acidity of 200 mg KOH/g or less, in some examples 190 mg or less, in some examples 180 mg or less, in some examples 130 mg KOH/g or less, in some examples 120 mg KOH/g or less. Acidity of a polymer, as measured in mg KOH/g can be measured using standard procedures known in the art, for example using the procedure described in ASTM D1386.

The resin may comprise a polymer, in some examples a polymer having acidic side groups, that has a melt flow rate of less than about 70 g/10 minutes, in some examples about 60 g/10 minutes or less, in some examples about 50 g/10 minutes or less, in some examples about 40 g/10 minutes or less, in some examples 30 g/10 minutes or less, in some examples 20 g/10 minutes or less, in some examples 10 g/10 minutes or less. In some examples, all polymers having acidic side groups and/or ester groups in the particles each individually have a melt flow rate of less than 90 g/10 minutes, 80 g/10 minutes or less, in some examples 80 g/10 minutes or less, in some examples 70 g/10 minutes or less, in some examples 70 g/10 minutes or less, in some examples 60 g/10 minutes or less.

The polymer having acidic side groups can have a melt flow rate of about 10 g/10 minutes to about 120 g/10 minutes, in some examples about 10 g/10 minutes to about 70 g/10 minutes, in some examples about 10 g/10 minutes to 40 g/10 minutes, in some examples 20 g/10 minutes to 30 g/10 minutes. The polymer having acidic side groups can have a melt flow rate of, in some examples, about 50 g/10 minutes to about 120 g/10 minutes, in some examples 60 g/10 minutes to about 100 g/10 minutes. The melt flow rate can be measured using standard procedures known in the art, for example as described in ASTM D1238.

The acidic side groups may be in free acid form or may be in the form of an anion and associated with one or more counterions, typically metal counterions, e.g. a metal selected from the alkali metals, such as lithium, sodium and potassium, alkali earth metals, such as magnesium or calcium, and transition metals, such as zinc. The polymer having acidic sides groups can be selected from resins such as co-polymers of ethylene and an ethylenically unsaturated acid of either acrylic acid or methacrylic acid; and ionomers thereof, such as methacrylic acid and ethylene-acrylic or methacrylic acid co-polymers which are at least partially neutralized with metal ions (e.g. Zn, Na, Li) such as SURLYN® ionomers. The polymer comprising acidic side groups can be a co-polymer of ethylene and an ethylenically unsaturated acid of either acrylic or methacrylic acid, where the ethylenically unsaturated acid of either acrylic or methacrylic acid constitute from 5 wt % to about 25 wt % of the co-polymer, in some examples from 10 wt % to about 20 wt % of the co-polymer.

The resin may comprise two different polymers having acidic side groups. The two polymers having acidic side groups may have different acidities, which may fall within the ranges mentioned above. The resin may comprise a first polymer having acidic side groups that has an acidity of from 10 mg KOH/g to 110 mg KOH/g, in some examples 20 mg KOH/g to 110 mg KOH/g, in some examples 30 mg KOH/g to 110 mg KOH/g, in some examples 50 mg KOH/g to 110 mg KOH/g, and a second polymer having acidic side groups that has an acidity of 110 mg KOH/g to 130 mg KOH/g.

The resin may comprise two different polymers having acidic side groups: a first polymer having acidic side groups that has a melt flow rate of about 10 g/10 minutes to about 50 g/10 minutes and an acidity of from 10 mg KOH/g to 110 mg KOH/g, in some examples 20 mg KOH/g to 110 mg KOH/g, in some examples 30 mg KOH/g to 110 mg KOH/g, in some examples 50 mg KOH/g to 110 mg KOH/g, and a second polymer having acidic side groups that has a melt flow rate of about 50 g/10 minutes to about 120 g/10 minutes and an acidity of 110 mg KOH/g to 130 mg KOH/g. The first and second polymers may be absent of ester groups.

The ratio of the first polymer having acidic side groups to the second polymer having acidic side groups can be from about 10:1 to about 2:1. The ratio can be from about 6:1 to about 3:1, in some examples about 4:1.

The resin may comprise a polymer having a melt viscosity of 15000 poise or less, in some examples a melt viscosity of 10000 poise or less, in some examples 1000 poise or less, in some examples 100 poise or less, in some examples 50 poise or less, in some examples 10 poise or less; said polymer may be a polymer having acidic side groups as described herein. The resin may comprise a first polymer having a melt viscosity of 15000 poise or more, in some examples 20000 poise or more, in some examples 50000 poise or more, in some examples 70000 poise or more; and in some examples, the resin may comprise a second polymer having a melt viscosity less than the first polymer, in some examples a melt viscosity of 15000 poise or less, in some examples a melt viscosity of 10000 poise or less, in some examples 1000 poise or less, in some examples 100 poise or less, in some examples 50 poise or less, in some examples 10 poise or less. The resin may comprise a first polymer having a melt viscosity of more than 60000 poise, in some examples from 60000 poise to 100000 poise, in some examples from 65000 poise to 85000 poise; a second polymer having a melt viscosity of from 15000 poise to 40000 poise, in some examples 20000 poise to 30000 poise, and a third polymer having a melt viscosity of 15000 poise or less, in some examples a melt viscosity of 10000 poise or less, in some examples 1000 poise or less, in some examples 100 poise or less, in some examples 50 poise or less, in some examples 10 poise or less; an example of the first polymer is Nucrel 960 (from DuPont), and example of the second polymer is Nucrel 699 (from DuPont), and an example of the third polymer is AC-5120 or AC-5180 (from Honeywell). The first, second and third polymers may be polymers having acidic side groups as described herein. The melt viscosity can be measured using a rheometer, e.g. a commercially available AR-2000 Rheometer from Thermal Analysis Instruments, using the geometry of: 25 mm steel plate-standard steel parallel plate, and finding the plate over plate rheometry isotherm at 120° C., 0.01 hz shear rate.

If the resin in the electrophotographic composition comprises a single type of polymer, the polymer (excluding any other components of the electrostatic composition) may have a melt viscosity of 6000 poise or more, in some examples a melt viscosity of 8000 poise or more, in some examples a melt viscosity of 10000 poise or more, in some examples a melt viscosity of 12000 poise or more. If the resin comprises a plurality of polymers all the polymers of the resin may together form a mixture (excluding any other components of the electrostatic composition) that has a melt viscosity of 6000 poise or more, in some examples a melt viscosity of 8000 poise or more, in some examples a melt viscosity of 10000 poise or more, in some examples a melt viscosity of 12000 poise or more. Melt viscosity can be measured using standard techniques. The melt viscosity can be measured using a rheometer, e.g. a commercially available AR-2000 Rheometer from Thermal Analysis Instruments, using the geometry of: 25 mm steel plate-standard steel parallel plate, and finding the plate over plate rheometry isotherm at 120° C., 0.01 hz shear rate.

The resin may comprise two different polymers having acidic side groups that are selected from co-polymers of ethylene and an ethylenically unsaturated acid of either acrylic acid or methacrylic acid; or ionomers thereof, such as methacrylic acid and ethylene-acrylic or methacrylic acid co-polymers which are at least partially neutralized with metal ions (e.g. Zn, Na, Li) such as SURLYN® ionomers. The resin may comprise (i) a first polymer that is a co-polymer of ethylene and an ethylenically unsaturated acid of either acrylic acid and methacrylic acid, wherein the ethylenically unsaturated acid of either acrylic or methacrylic acid constitutes from 8 wt % to about 16 wt % of the co-polymer, in some examples 10 wt % to 16 wt % of the co-polymer; and (ii) a second polymer that is a co-polymer of ethylene and an ethylenically unsaturated acid of either acrylic acid and methacrylic acid, wherein the ethylenically unsaturated acid of either acrylic or methacrylic acid constitutes from 12 wt % to about 30 wt % of the co-polymer, in some examples from 14 wt % to about 20 wt % of the co-polymer, in some examples from 16 wt % to about 20 wt % of the co-polymer in some examples from 17 wt % to 19 wt % of the co-polymer.

The resin may comprise a polymer having acidic side groups, as described above (which may be free of ester side groups), and a polymer having ester side groups. The polymer having ester side groups may be a thermoplastic polymer. The polymer having ester side groups may further comprise acidic side groups. The polymer having ester side groups may be a co-polymer of a monomer having ester side groups and a monomer having acidic side groups. The polymer may be a co-polymer of a monomer having ester side groups, a monomer having acidic side groups, and a monomer absent of any acidic and ester side groups. The monomer having ester side groups may be a monomer selected from esterified acrylic acid or esterified methacrylic acid. The monomer having acidic side groups may be a monomer selected from acrylic or methacrylic acid. The monomer absent of any acidic and ester side groups may be an alkylene monomer, including, but not limited to, ethylene or propylene. The esterified acrylic acid or esterified methacrylic acid may, respectively, be an alkyl ester of acrylic acid or an alkyl ester of methacrylic acid. The alkyl group in the alkyl ester of acrylic or methacrylic acid may be an alkyl group having 1 to 30 carbons, in some examples 1 to 20 carbons, in some examples 1 to 10 carbons; in some examples selected from methyl, ethyl, iso-propyl, n-propyl, t-butyl, iso-butyl, n-butyl and pentyl.

The polymer having ester side groups may be a co-polymer of a first monomer having ester side groups, a second monomer having acidic side groups and a third monomer which is an alkylene monomer absent of any acidic and ester side groups. The polymer having ester side groups may be a co-polymer of (i) a first monomer having ester side groups selected from esterified acrylic acid or esterified methacrylic acid, in some examples an alkyl ester of acrylic or methacrylic acid, (ii) a second monomer having acidic side groups selected from acrylic or methacrylic acid and (iii) a third monomer which is an alkylene monomer selected from ethylene and propylene. The first monomer may constitute 1% to 50% by weight of the co-polymer, in some examples 5% to 40% by weight, in some examples 5% to 20% by weight of the co-polymer, in some examples 5% to 15% by weight of the co-polymer. The second monomer may constitute 1% to 50% by weight of the co-polymer, in some examples 5% to 40% by weight of the co-polymer, in some examples 5% to 20% by weight of the co-polymer, in some examples 5% to 15% by weight of the co-polymer. The first monomer can constitute 5% to 40% by weight of the co-polymer, the second monomer constitutes 5% to 40% by weight of the co-polymer, and with the third monomer constituting the remaining weight of the co-polymer. In some examples, the first monomer constitutes 5% to 15% by weight of the co-polymer, the second monomer constitutes 5% to 15% by weight of the co-polymer, with the third monomer constituting the remaining weight of the co-polymer. In some examples, the first monomer constitutes 8% to 12% by weight of the co-polymer, the second monomer constitutes 8% to 12% by weight of the co-polymer, with the third monomer constituting the remaining weight of the co-polymer. In some examples, the first monomer constitutes about 10% by weight of the co-polymer, the second monomer constitutes about 10% by weight of the co-polymer, and with the third monomer constituting the remaining weight of the co-polymer. The polymer may be selected from the Bynel® class of monomer, including Bynel 2022 and Bynel 2002, which are available from DuPont®.

The polymer having ester side groups may constitute 1% or more by weight of the total amount of the resin polymers, e.g. thermoplastic resin polymers, in the liquid electrophotographic composition, e.g. the total amount of the polymer or polymers having acidic side groups and polymer having ester side groups. The polymer having ester side groups may constitute 5% or more by weight of the total amount of the resin polymers, e.g. thermoplastic resin polymers, in some examples 8% or more by weight of the total amount of the resin polymers, e.g. thermoplastic resin polymers, in some examples 10% or more by weight of the total amount of the resin polymers, e.g. thermoplastic resin polymers, in some examples 15% or more by weight of the total amount of the resin polymers, e.g. thermoplastic resin polymers, in some examples 20% or more by weight of the total amount of the resin polymers, e.g. thermoplastic resin polymers, in some examples 25% or more by weight of the total amount of the resin polymers, e.g. thermoplastic resin polymers, in some examples 30% or more by weight of the total amount of the resin polymers, e.g. thermoplastic resin polymers, in some examples 35% or more by weight of the total amount of the resin polymers, e.g. thermoplastic resin polymers, in the liquid electrophotographic composition. The polymer having ester side groups may constitute from 5% to 50% by weight of the total amount of the resin polymers, e.g. thermoplastic resin polymers, in the liquid electrophotographic composition, in some examples 10% to 40% by weight of the total amount of the resin polymers, e.g. thermoplastic resin polymers, in the liquid electrophotographic composition, in some examples 5% to 30% by weight of the total amount of the resin polymers, e.g. thermoplastic resin polymers, in the liquid electrophotographic composition, in some examples 5% to 15% by weight of the total amount of the resin polymers, e.g. thermoplastic resin polymers, in the liquid electrophotographic composition in some examples 15% to 30% by weight of the total amount of the resin polymers, e.g. thermoplastic resin polymers, in the liquid electrophotographic composition.

The polymer having ester side groups may have an acidity of 50 mg KOH/g or more, in some examples an acidity of 60 mg KOH/g or more, in some examples an acidity of 70 mg KOH/g or more, in some examples an acidity of 80 mg KOH/g or more. The polymer having ester side groups may have an acidity of 100 mg KOH/g or less, in some examples 90 mg KOH/g or less. The polymer having ester side groups may have an acidity of 60 mg KOH/g to 90 mg KOH/g, in some examples 70 mg KOH/g to 80 mg KOH/g.

The polymer having ester side groups may have a melt flow rate of about 10 g/10 minutes to about 120 g/10 minutes, in some examples about 10 g/10 minutes to about 50 g/10 minutes, in some examples about 20 g/10 minutes to about 40 g/10 minutes, in some examples about 25 g/10 minutes to about 35 g/10 minutes.

The polymer, polymers, co-polymer or co-polymers of the resin can in some examples be selected from the Nucrel family of toners (e.g. Nucrel 403™, Nucrel 407™, Nucrel 609HS™, Nucrel 908HS™, Nucrel 1202HC™, Nucrel 30707™, Nucrel 1214™, Nucrel 903™, Nucrel 3990™, Nucrel 910™, Nucrel 925™, Nucrel 699™, Nucrel 599™, Nucrel 960™, Nucrel RX76™, Nucrel 2806™, Bynell 2002, Bynell 2014, Bynell 2020 and Bynell 2022, (sold by E. I. du PONT)), the Aclyn family of toners (e.g. Aclyn 201, Aclyn 246, Aclyn 285, and Aclyn 295), and the Lotader family of toners (e.g. Lotader 2210, Lotader, 3430, and Lotader 8200 (sold by Arkema)).

The resin can constitute about 5 to 90%, in some examples about 50 to 80%, by weight of the solids of the liquid electrophotographic composition. The resin can constitute about 60 to 95%, in some examples about 70 to 95%, by weight of the solids of the liquid electrophotographic composition.

Charge Adjuvant

As mentioned above, the electrophotographic compositions (transparent electrophotographic composition and/or electrophotographic ink composition) can include a charge adjuvant. A charge adjuvant may be present with a charge director, and may be different to the charge director, and act to increase and/or stabilise the charge on particles, e.g. resin-containing particles, of an electrostatic composition. The charge adjuvant can include, but is not limited to, barium petronate, calcium petronate, Co salts of naphthenic acid, Ca salts of naphthenic acid, Cu salts of naphthenic acid, Mn salts of naphthenic acid, Ni salts of naphthenic acid, Zn salts of naphthenic acid, Fe salts of naphthenic acid, Ba salts of stearic acid, Co salts of stearic acid, Pb salts of stearic acid, Zn salts of stearic acid, Al salts of stearic acid, Cu salts of stearic acid, Fe salts of stearic acid, metal carboxylates (e.g. Al tristearate, Al octanoate, Li heptanoate, Fe stearate, Fe distearate, Ba stearate, Cr stearate, Mg octanoate, Ca stearate, Fe naphthenate, Zn naphthenate, Mn heptanoate, Zn heptanoate, Ba octanoate, Al octanoate, Co octanoate, Mn octanoate, and Zn octanoate), Co lineolates, Mn lineolates, Pb lineolates, Zn lineolates, Ca oleates, Co oleates, Zn palmirate, Ca resinates, Co resinates, Mn resinates, Pb resinates, Zn resinates, AB diblock co-polymers of 2-ethylhexyl methacrylate-co-methacrylic acid calcium, and ammonium salts, co-polymers of an alkyl acrylamidoglycolate alkyl ether (e.g. methyl acrylamidoglycolate methyl ether-co-vinyl acetate), and hydroxy bis(3,5-di-tert-butyl salicylic) aluminate monohydrate. In some examples, the charge adjuvant is aluminium di and/or tristearate and/or aluminium di and/or tripalmitate.

The charge adjuvant can constitute about 0.1 to 5% by weight of the solids of the liquid electrophotographic composition. The charge adjuvant can constitute about 0.5 to 4% by weight of the solids of the liquid electrophotographic composition. The charge adjuvant can constitute about 1 to 3% by weight of the solids of the liquid electrophotographic composition.

Charge Director

A charge director may be added to the electrophotographic compositions (transparent electrophotographic composition and/or electrophotographic ink composition). In some examples, the charge director comprises nanoparticles of a simple salt and a salt of the general formula $MA_n$, wherein M is a barium, n is 2, and A is an ion of the general formula $[R_1—O—C(O)CH_2CH(SO_3^-)C(O)—O—R_2]$, where each of $R_1$ and $R_2$ is an alkyl group.

The sulfosuccinate salt of the general formula $MA_n$ is an example of a micelle forming salt. The charge director may be substantially free or free of an acid of the general formula HA, where A is as described above. The charge director may comprise micelles of said sulfosuccinate salt enclosing at least some of the nanoparticles. The charge director may comprise at least some nanoparticles having a size of 10 nm or less, in some examples 2 nm or more (e.g. 4-6 nm).

The simple salt may comprise a cation selected from Mg, Ca, Ba, $NH_4$, tert-butyl ammonium, $Li^+$, and $Al^{+3}$, or from any sub-group thereof. In one example, the simple salt is an inorganic salt, for instance, a barium salt. The simple salt may comprise an anion selected from $SO_4^{2-}$, $PO^{3-}$, $NO_3^-$, $HPO_4^{2-}$, $CO_3^{2-}$, acetate, trifluoroacetate (TFA), $Cl^-$, Bf, $F^-$, $ClO_4^-$, and $TiO_3^{4-}$, or from any sub-group thereof. In some examples, the simple salt comprises a hydrogen phosphate anion.

The simple salt may be selected from $CaCO_3$, $Ba_2TiO_3$, $Al_2(SO_4)_3$, $Al(NO_3)_3$, $Ca_3(PO_4)_2$, $BaSO_4$, $BaHPO_4$, $Ba_2(PO_4)_3$, $CaSO_4$, $(NH_4)_2CO_3$, $(NH_4)_2SO_4$, $NH_4OAc$, Tert-butyl ammonium bromide, $NH_4NO_3$, LiTFA, $Al_2(SO_4)_3$, $LiClO_4$ and $LiBF_4$, or any sub-group thereof.

In one example, the simple salt may be $BaHPO_4$.

In the formula $[R_1—O—C(O)CH_2CH(SO_3^-)C(O)—O—R_2]$, in some examples, each of $R_1$ and $R_2$ is an aliphatic alkyl group. In some examples, each of $R_1$ and $R_2$ independently is a $C_{6-25}$ alkyl. In some examples, said aliphatic alkyl group is linear. In some examples, said aliphatic alkyl group is branched. In some examples, said aliphatic alkyl group includes a linear chain of more than 6 carbon atoms. In some examples, $R_1$ and $R_2$ are the same. In some examples, at least one of $R_1$ and $R_2$ is $C_{13}H_{27}$.

In an electrophotographic composition, the charge director can constitute about 0.001% to 20%, in some examples 0.01 to 20% by weight, in some examples 0.01 to 10% by weight, in some examples 0.01 to 1% by weight of the solids of the electrostatic composition. The charge director can constitute about 0.001 to 0.15% by weight of the solids of the liquid electrophotographic composition, in some examples 0.001 to 0.15%, in some examples 0.001 to 0.02% by weight of the solids of the liquid electrophotographic composition. In some examples, the charge director imparts a negative charge on the electrostatic composition. The particle conductivity may range from 50 to 500 pmho/cm, in some examples from 200-350 pmho/cm.

Carrier Liquid

The carrier liquid for the liquid electrophotographic composition (transparent electrophotographic composition and electrophotographic ink composition) can act as a dispersing medium for the other components in the electrostatic composition. For example, the carrier liquid can comprise or be a hydrocarbon, silicone oil, vegetable oil, etc. The carrier liquid can include, but is not limited to, an insulating, non-polar, non-aqueous liquid that can be used as a medium for toner particles. The carrier liquid can include compounds that have a resistivity in excess of about $10^9$ ohm-cm. The carrier liquid may have a dielectric constant below about 5, in some examples below about 3. The carrier liquid can include, but is not limited to, hydrocarbons. The hydrocarbon can include, but is not limited to, an aliphatic hydrocarbon, an isomerized aliphatic hydrocarbon, branched chain aliphatic hydrocarbons, aromatic hydrocarbons, and combinations thereof. Examples of the carrier liquids include, but are not limited to, aliphatic hydrocarbons, isoparaffinic compounds, paraffinic compounds, dearomatized hydrocarbon compounds, and the like. In some examples, the carrier liquid is an isoparaffinic liquid. In particular, the carrier liquids can include, but are not limited to liquids sold under the trademarks, Isopar-G™, Isopar-H™, Isopar-L™, Isopar-M™, Isopar-K™, Isopar-V™, Norpar 12™, Norpar 13™, Norpar 15™, Exxol D40™, Exxol D80™, Exxol D100™, Exxol D130™, and Exxol D140™ (each sold by EXXON CORPORATION); Teclen N-16™, Teclen N-20™, Teclen N-22™, Nisseki Naphthesol L™, Nisseki Naphthesol M™, Nisseki Naphthesol H™, #0 Solvent L™, #0 Solvent M™, #0 Solvent H™, Nisseki Isosol 300™, Nisseki Isosol 400™, AF-4™, AF-5™, AF-6™ and AF-7™ (each sold by NIPPON OIL CORPORATION); IP Solvent 1620™ and IP Solvent 2028™ (each sold by IDEMITSU PETROCHEMICAL CO., LTD.); Amsco OMS™ and Amsco 460™ (each sold by AMERICAN MINERAL SPIRITS CORP.); and Electron, Positron, New II, Purogen HF (100% synthetic terpenes) (sold by ECOLINK™)

Before printing, the carrier liquid can constitute about 20% to 99.5% by weight of the electrostatic composition, in some examples 50% to 99.5% by weight of the electrostatic composition. Before printing, the carrier liquid may constitute about 40 to 90% by weight of the electrostatic composition. Before printing, the carrier liquid may constitute about 60% to 80% by weight of the electrostatic composition. Before printing, the carrier liquid may constitute about 90% to 99.5% by weight of the electrostatic composition, in some examples 95% to 99% by weight of the electrostatic composition.

The composition when printed on the print substrate, may be substantially free from carrier liquid. In an electrostatic printing process and/or afterwards, the carrier liquid may be removed, e.g. by an electrophoresis processes during printing and/or evaporation, such that substantially just solids are transferred to the print substrate. Substantially free from carrier liquid may indicate that the ink printed on the print substrate contains less than 5 wt % carrier liquid, in some examples, less than 2 wt % carrier liquid, in some examples less than 1 wt % carrier liquid, in some examples less than 0.5 wt % carrier liquid. In some examples, the ink printed on the print substrate is free from carrier liquid.

Colorants

Colorants may be absent from the transparent electrophotographic composition used as the first ink. However, the electrophotographic ink composition may include a colorant. The colorant may be selected from a pigment, dye and a combination thereof. The colorant may be selected from a cyan colorant, a yellow colorant, a magenta colorant and a black colorant. The colorant may be selected from a phthalocyanine colorant, an indigold colorant, an indanthrone colorant, a monoazo colorant, a diazo colorant, inorganic salts and complexes, dioxazine colorant, perylene colorant, anthraquinone colorants, and any combination thereof.

Where present, the colorant may be present in an amount of 0.1 to 10 weight %, for instance, 2 to 5 weight % of the total weight of solids of the composition.

Transparent Electrophotographic Composition

As mentioned above, the present disclosure also relates to a liquid transparent electrophotographic composition. The composition comprises an epoxy resin; a copolymer of an olefin and methacrylic acid and/or a copolymer of an olefin and acrylic acid; a charge adjuvant; and a liquid carrier. The total amount of epoxy resin is 10 to 95 weight % of the total weight of solids in the composition.

In one example, the total amount of epoxy resin may be 40 to 90 weight % of the total weight of solids in the composition, for example, 50 to 80 weight % of the total weight of solids in the composition.

In one example, the total amount of copolymer of an olefin and methacrylic acid and/or a copolymer of an olefin and acrylic acid may be from 5 to up to 90 weight % of the total amount of solids in the composition, for example, 10 to 60 weight % or 30 to 50 weight % of the total weight of solids in the composition.

In one example, the weight ratio of epoxy resin to the total amount of copolymer of an olefin and methacrylic acid and/or a copolymer of an olefin and acrylic acid may be 1:9 to 19:1, for example, 1:5 to 15:1. In one example, the weight ratio of epoxy resin to the total amount of copolymer of an olefin and methacrylic acid and/or a copolymer of an olefin and acrylic acid may be 1:2 to 10:1, for example, 2:3 to 9:1.

Examples of suitable epoxy resins, copolymers of an olefin and methacrylic acid and/or a copolymer of an olefin and acrylic acid, charge adjuvants and liquid carriers are described in detail above.

Particles of epoxy resin and particles of copolymer of an olefin and methacrylic acid and/or a copolymer of an olefin and acrylic acid may be ground and dispersed in the carrier liquid. Alternatively, particles of epoxy resin may be dispersed in a melt of the copolymer of an olefin and methacrylic acid and/or a copolymer of an olefin and acrylic acid. Upon cooling, the resulting composite may be ground to form composite particles of epoxy resin and copolymer of an olefin and methacrylic acid and/or a copolymer of an olefin and acrylic acid.

By tailoring the viscosity of the transparent electrophotographic composition accordingly, for example, by omitting addition of colorants that may otherwise increase viscosity (e.g. pigments), it is possible to produce a transparent electrophotographic composition that has flow properties required to coat the prime and provide an effective coupling layer for coupling to the primer and/or image layer.

In one example, the transparent electrophotographic composition is devoid of pigment. In other examples, the transparent electrophotographic composition comprises less than 0.1 weight % pigment (e.g. 0 to 0.1 weight %), for example, less than 0.05 weight % pigment (e.g. 0 to 0.05 weight %) based on the total weight of solids of the composition.

In some examples, once printed, the transparent electrophotographic composition forms a layer of less than 10 μm in thickness, for example less than 9 μm in thickness, less than 8 μm in thickness, less than 7 μm in thickness, less than 6 μm in thickness, less than 5 μm in thickness, less than 4 μm in thickness, less than 3 μm in thickness, less than 2 μm in thickness, less than 1.5 μm in thickness. In some examples, the transparent electrostatic ink composition is about 1 μm in thickness.

In some examples, once printed, the transparent electrophotographic composition forms a layer greater than 0.1 μm in thickness, for example greater than 0.2 μm in thickness, greater than 0.3 μm in thickness, greater than 0.4 μm in thickness, greater than 0.5 μm in thickness, greater than 0.6 μm in thickness, greater than 0.7 μm in thickness, greater than 0.8 μm in thickness, greater than 0.9 μm in thickness. In some examples, the film of material is 0.1 to 5 μm thick, for example, 0.3 to 2 μm thick. In some examples, the film may be 0.5 to 1.5 μm thick.

The transparent electrophotographic composition may be applied to the primer-coated substrate. In one example, the transparent electrophotographic composition may be applied over the primer-coated substrate, such that the transparent electrophotographic composition covers areas of the substrate that are intended to be printed (or printed) with an image formed from the electrophotographic ink composition and areas of the substrate that are intended to be left (or are left) unprinted by the electrophotographic ink composition. Accordingly, the coupling layer may be present over both the non-image-bearing areas and the image-bearing areas of the substrate. In one example, the transparent electrophotographic composition is printed over the primer coated substrate, such that at least 70% (e.g. 80 to 100%) of the primer layer is coated. In an alternative example, the transparent electrophotographic composition may be selectively applied to the areas of the substrate that are intended to be printed (or printed) with the electrophotographic ink composition. Accordingly, the coupling layer may be present over the image-bearing areas of the substrate. Primed areas of substrate that do not bear an image (i.e. are not printed with the electrophotographic ink composition) may also be devoid of transparent electrophotographic composition.

Primer

Any suitable primer may be used in the process of the present disclosure. Suitable primers include polymeric primers, for example, comprising a polymer and a solvent. In some examples, the primer comprises a polymer emulsion. Suitable solvents include aqueous solvents, for example, water. The concentration of polymer in the solvent may be 5 to 30 weight %, for example, 10 to 15 weight %.

In some examples, the primer may be selected from ethylene acrylic/methacrylic acid or acrylate/methacrylate copolymer emulsions, ethylene acrylic ionomers (saponified acrylic acid), polyamides, polyurethanes, polyamines, polyethylene imines, ethylene vinyl alcohol and ethylene vinyl acetate copolymer emulsions. The primer may also comprise a polymer comprising a polar group. Examples of polar groups include sulfonic, phosphonic, anhydride and silane groups.

In one example, a primer coating comprising a mixture of: a) about 60 to 95% by weight of a copolymer of ethylene and acrylic or methacrylic acid in an aqueous dispersion containing from about 10 to about 40% by weight total solids; and b) about 10 to 40% by weight of an adhesion enhancer comprising a hydrogenated rosin or rosin ester. Examples of such primers are described in U.S. Pat. No. 8,198,353. In one example, the primer comprises polyethylene imine. In one example, the primer comprises a 1 to 30 weight % (e.g. 5 to 20 weight %) polyethylene imine dissolved in water. In some examples, the primer is a primer sold under the trademark Michelman® DP050 and Michelman® DP030.

The primer may also include at least one of crosslinkers, antifoaming agents, levelling (wetting) agents, and anti-blocking agents.

The primer may be applied as a layer in an amount of 0.01 to 5 $g/m^2$ of substrate, for example, 0.02 to 3 $g/m^2$ of substrate. In one example, the primer is applied in an amount of 0.03 to 1.5 $g/m^2$ of substrate, for example, 0.04 to 1 $g/m^2$ of substrate. In one example, the primer is applied in an amount of 0.05 to 0.8 $g/m^2$ of substrate, for example, 0.1 to 0.5 $g/m^2$ of substrate.

The primer may be applied using any suitable analogue method, including painting, dipping, spreading and gravure coating. The primer may be applied by any mechanical means and is not digitally printed.

The primer is an analogue primer that is not suitable for electrophotographic printing. For example, the primer may be devoid of charge adjuvant and/or charge director. The primer may be a non-selective analogue primer, as it cannot be targeted onto selected areas of the substrate by digital printing.

Over Print Varnish (OPV)

In some examples, the printed material may comprise an over print varnish (OPV) disposed on the image layer of the printed substrate.

In some examples the OPV is a water-based OPV (e.g. an OPV comprising an OPV dispersed in water), a solvent-based OPV (e.g. an OPV comprising an OPV resin dissolved in an organic solvent such as ethyl acetate, n-propanol or ethanol), a UV curable OPV (e.g. an OPV comprising an OPV UV curable resin and a photo-initiator) or an electron beam OPV. Suitable OPV are standardly used OPVs.

In some examples the OPV comprises an OPV resin comprising an acrylate resin, a polyurethane resin or a nitrocellulose resin. When the OPV resin comprises a polyurethane resin, the OPV resin may comprise a one component or a two component polyurethane resin.

In some examples, the OPV is selected from a water-based OPV comprising acrylate resin or polyurethane resin; a solvent-based OPV comprising nitrocellulose resin or polyurethane resin; and a UV curable OPV comprising acrylate resin or polyurethane resin.

In some examples, the OPV is deposited on the print substrate such that the coat weight of the OPV resin on the print substrate is in the range of about 0.5 $g \cdot m^{-2}$ to about 10 $g \cdot m^{-2}$, in some examples about 1 $g \cdot m^{-2}$ to about 5 $g \cdot m^{-2}$.

Print Substrate

The process of the present disclosure may be used to print any suitable substrate. The substrate may be a polymer. In some examples, the substrate is a flexible substrate, for instance, a flexible polymer substrate. In some examples, the substrate is a polymer film. In some examples, the substrate is a paper film or paper substrate. In some examples, the substrate may be fabric. The substrate may additionally include metal, for example, as a coating or support layer. The substrate may be a label for attachment to packaging or may be a labelled item of packaging. The substrate may be a laminated substrate.

In some examples, the substrate may be formed of a polymer selected from polyethylene (PE), linear low density polyethylene (LLDPE), low density polyethylene (LDPE), polypropylene (PP), biaxially oriented polypropylene (BOPP), polyethylene terephthalate, polyamide, biaxially oriented polyamide, and polyvinyl chloride.

Once printed, the substrate may be processed and formed into a variety of articles, including labels and flexible packaging. In one example, the substrate may be formed into a shrink sleeve.

Where the substrate is a label, the label may be a pressure sensitive label, a glue-applied label and heat transfer label, for example, for use in the textile industry. Other labels include in-mould labels that are used in the manufacturing of moulded articles including blow-moulded, In some examples, the substrate comprises a film of material, wherein the film is less than 100 μm in thickness, for example less than 90 μm in thickness, less than 80 μm in thickness, less than 70 μm in thickness, less than 60 μm in thickness, less than 50 μm in thickness, less than 40 μm in thickness, less than 30 μm in thickness, less than 20 μm in thickness, less than 15 μm in thickness. In some examples, the film of material is about 12 μm in thickness.

In some examples, the substrate comprises a film of material, wherein the film is greater than 12 μm in thickness, for example greater than 15 μm in thickness, greater than 20 μm in thickness, greater than 30 μm in thickness, greater than 40 μm in thickness, greater than 50 μm in thickness, greater than 60 μm in thickness, greater than 70 μm in thickness, greater than 80 μm in thickness, greater than 90 μm in thickness. In some examples, the film of material is about 100 μm in thickness.

Prior to printing the transparent electrophotographic ink onto the substrate, the substrate may be treated by corona treatment.

Printing

The FIGURE is a schematic diagram a substrate that has been printed according to an example of the present disclosure. The substrate (10) is first primed with an analogue primer as a primer layer (12). The analogue primer may be applied by mechanical or non-digital methods, for example, by gravure coating. A transparent electrophotographic composition comprising a coupling agent may then be electrophotographically printed on to the primer layer (12) as a coupling layer (14). An electrophotographic ink composition is then electrophotographically printed over the coupling layer (14) as an image layer (16). Thereafter, an over print varnish (OPV) is applied to the image layer (16) as a varnish layer (18). The printed substrate may have an improved resistance to, for example, water, heat and/or chemicals (e.g. solvents).

The electrophotographic printing steps may be carried out sequentially in-line using the same electrophotographic printer. For example, a latent electrophotographic image may first be formed on a photo-imaging surface. The photo-imaging surface may then be contacted with the transparent electrophotographic composition, such that at least some of the electrophotographic composition adheres to the surface to form a developed toner image on the surface. The toner image is then transferred to the substrate, in some examples via an intermediate transfer member. The process is then repeated using the electrophotographic ink composition(s) to form the image layer. The transparent electrophotographic composition and the electrophotographic composition may be subjected to an elevated temperature during the electrophotographic printing process. For example, the blanket and/or substrate may be heated to a temperature of at least 85 degrees C., for instance, 90 to 110 degrees C. during the electrophotographic printing process. Such temperatures may be sufficient to activate the coupling agent. For instance, in the case of a crosslinking agent (e.g. an epoxide resin), the elevated temperatures encountered during the electrophotographic printing step may be sufficient to initiate or effect a crosslinking reaction between the crosslinking agent and resin in the primer and/or image layer.

EXAMPLES

In the following examples, 'Isopar' is Isopar™ L Fluid, produced by ExxonMobil and having CAS Number 64742-48-9.

In the following examples, the resin used is Nucrel 699, available from DuPont, and A-C 5120, available from Honeywell, in a weight ratio of 4:1.

In the following examples, NCD indicates a natural charge director made of three components: KT (natural soya lecithin in phospholipids and fatty acids), BBP (basic barium petronate i.e. a barium sulfonate salt of a 21-26 hydrocarbon alkyl, supplied by Chemtura®), and GT (dodecyl benzene sulfonic acid isopropyl amine, supplied by Croda®). The composition being 6.6 wt % KT, 9.8 wt % BBP and 3.6 wt % GT, balance 80% Isopar.

In the following examples, 1,1,2,2-tetrakis (4-glycidoxyphenyl) ethane sold under the trademark EPON1031 (Momentive) was used as an epoxy resin.

In the following examples, a polyethyleneimine primer sold under the trademark DiGiPrime050 (Michelmann) was used as the analogue primer.

Example 1

A transparent electrophotographic composition comprising an epoxy resin as a coupling agent was prepared as follows (70 weight % epoxy resin based on total amount of solids in composition):

28 g of 1,1,2,2-tetrakis (4-glycidoxyphenyl) ethane sold under the trademark EPON1031 (Momentive) was ground in a pestle and mortar. This epoxy resin was mixed with 45.6 g of a paste (Nucrel 699 and A-C 5120 in a weight ratio of 4:1 in Isopar—35 weight % solids), 0.6 g of aluminum stearate (Sigma-Aldridge) and 125 gr of Isopar. The mixture was ground for 24 hours at 25° C. using a laboratory 01HD attritor from Union Process (USA). After grinding, the mixture was diluted with Isopar to obtain 2% dispersion and charged with NCD over 20 hours.

Example 2

In this example, a label substrate formed of polyethylene was primed using an analogue primer sold under the trademark DiGiPrime050 (Michelmann). The transparent electrophotographic composition produced in Example 1 was printed as one separation on the top of the primer. A commercially available electrophotographic ink composition comprising a colorant was then printed over the transparent electrophotographic composition as an image layer. Different ink coverages were applied while printing: low ink coverage (100-200%) for patches 1-12 and high ink coverage (300-400%) for the patches 13-24.

The printed image layer was then coated by overprint varnish, OPV (Actega 617 UV varnish) and the OPV cured.

Comparative Example 3

Example 2 was repeated but without the transparent electrophotographic composition. Thus, the electrophotographic ink was electrophotographically printed directly over the primer.

Example 4

In this Example, various properties of the substrates of Example 2 and Comparative Example 3 were tested.

Water Resistance

Labels printed according to Examples 2 and Comparative Examples 3 were immersed in water for different periods of time (see table 1) at room temperature. The samples were then wiped quickly and subjected to a standard peeling test. In this test, a piece of adhesive tape (Tape 810 scotch, 3M) was placed over the top of the printed surface of the substrates. A 2 kg rubber roller was rolled over the back of adhesive tape to enhance adhesion between the adhesive tape and the substrate. The adhesive tape was then peeled away from the substrate. The percentage of print remaining was recorded in Table 1. The higher the percentage, the greater the resistance to peeling.

The results show that the presence of the transparent electrophotographic composition as a coupling layer greatly improves the water resistance of the printed substrate.

| Example | Patch Number | Peeling before immersion in water (% left unpeeled) | Peeling after 1 hour (% left unpeeled) | Peeling after 3 hours (% left unpeeled) | Peeling after 24 hours (% left unpeeled) |
|---|---|---|---|---|---|
| 2 | 1-6 | 100% | 100% | 100% | 100% |
| 2 | 7-12 | 100% | 100% | 100% | 100% |
| 2 | 13-18 | 100% | 100% | 100% | 100% |
| 2 | 19-24 | 100% | 100% | 100% | 100% |
| Comp. 3 | 1-6 | 100% | 0% | Not tested | Not tested |
| Comp. 3 | 7-12 | 100% | 0% | Not tested | Not tested |
| Comp. 3 | 13-18 | 100% | 0% | Not tested | Not tested |
| Comp. 3 | 19-24 | 100% | 0% | Not tested | Not tested |

Hot Water Test:

Labels (Patches 19-24) printed according to Examples 2 and Comparative Examples 3 were immersed in water at 50 to 90 degrees C. for different periods of time (see table 2). The samples were then wiped quickly and subjected to a standard peeling test as described above. The results are shown in Table 2.

The results show that the presence of the transparent electrophotographic composition as a coupling layer greatly improves the hot water resistance of the printed substrate.

| | Peeling after water immersion for 10 mins (% left unpeeled) Water Temperature/degrees C. | | | | | Peeling after water immersion for 30 mins (% let unpeeled) |
|---|---|---|---|---|---|---|
| | 50 | 60 | 70 | 80 | 90 | 90 |
| Example 2 | 100% | 100% | 100% | 100% | 100% | 100% |
| Comparative Example 3 | 100% | 100% | 100% | 70% | 40% | Not tested |

Chemical Resistance

Samples produced according to Example 2 and Comparative Example 3 were dipped in a range of solvents (acetone, isopropyl alcohol (IPA), a pH4 buffer solution and a pH 10 buffer solution) for 30 minutes to an hour (table 3). The samples were then wiped and subjected to a standard peeling test as described above. The results are shown in Table 3 below.

The results show that the presence of the transparent electrophotographic composition as a coupling layer greatly improves the chemical resistance of the printed substrate.

| | Peeling after 30 minutes (% left unpeeled) Solvent | | | | Peeling after 2 hours (% left unpeeled) | | |
|---|---|---|---|---|---|---|---|
| | Acetone | IPA | Buffer pH 4 | Buffer pH 10 | IPA | Buffer pH 4 | Buffer pH 10 |
| Example 2 | 100% | 100% | 100% | 100% | 100% | 100% | 100% |
| Comparative Example 3 | 100% | 100% | 80% | 100% | 100% | 30% | 80% |

Example 5

In this example, a label substrate formed of polyethylene was primed using an analogue primer sold under the trademark DiGiPrime050 (Michelmann). A transparent electrophotographic composition (HP Transparent Electroink®) containing Nucrel 699 and A-C 5120 in a weight ratio of 4:1 was printed as one separation on the top of the primer. A commercially available electrophotographic ink composition comprising a colorant was then printed over the transparent electrophotographic composition as an image layer.

The printed image layer was then coated by overprint varnish, OPV (Actega 617 UV varnish) and the OPV cured.

Comparative Example 6

Example 5 was repeated but without the transparent electrophotographic composition. Thus, the electrophotographic ink was electrophotographically printed directly over the primer.

Example 7

Labels printed according to Examples 6 and Comparative Examples 7 were immersed in water for 30 minutes (see table below) at room temperature. The samples were then wiped quickly and subjected to a standard peeling test.

| Sample | Peeling after 30 min immersion in water, room temperature |
|---|---|
| Example 5 | 50% |
| Comparative Example 6 | 30% |

The invention claimed is:

1. A process for printing a substrate, said process comprising non-digitally applying an analogue primer over a print substrate, wherein the analogue primer is devoid of charge adjuvant and charge director, electrophotographically printing a transparent electrophotographic composition comprising a crosslinking agent including an epoxy, anhydride, isocyanate and/or carbodiimide group on the analogue primer as a coupling layer, wherein the transparent electrophotographic composition comprises an epoxy resin dispersed in a liquid carrier, and electrophotographically printing an electrophotographic ink composition on the coupling layer to form an image layer, wherein the coupling layer is disposed between the analogue primer and image layer and in contact with each of the analogue primer and image layer.

2. A process as claimed in claim 1, wherein the epoxy resin is present in an amount of 40 to 95 weight % of the total weight of solids in the transparent electrophotographic composition.

3. A process as claimed in claim 1, wherein the transparent electrophotographic composition comprises solid particles of the epoxy resin and solid particles comprising a copolymer of an olefin and methacrylic acid and/or a copolymer of an olefin and acrylic acid.

4. A process as claimed in claim 1, wherein the transparent electrophotographic composition comprises solid composite particles comprising i) the epoxy resin and ii) a copolymer of an olefin and methacrylic acid and/or a copolymer of an olefin and acrylic acid.

5. A process as claimed in claim 1, wherein the analogue primer comprises amine functional group.

6. A process as claimed in claim 1, wherein the transparent electrophotographic composition comprises a thermoplastic resin and a charge adjuvant dispersed in a liquid carrier.

7. A process as claimed in claim 1, wherein the electrophotographic ink composition comprises a colorant, a thermoplastic resin and a charge adjuvant dispersed in a liquid carrier.

8. A process as claimed in claim 1, wherein non-digitally applying the analogue primer is by painting, dipping, spreading, or gravure coating.

* * * * *